US008210642B2

(12) United States Patent
Yamamoto

(10) Patent No.: US 8,210,642 B2
(45) Date of Patent: Jul. 3, 2012

(54) INKJET RECORDING APPARATUS HAVING CLEANING MEMBER FOR CLEANING AN IMAGE SENSOR

(75) Inventor: Shinya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 767 days.

(21) Appl. No.: 12/324,013

(22) Filed: Nov. 26, 2008

(65) Prior Publication Data

US 2009/0141069 A1 Jun. 4, 2009

(30) Foreign Application Priority Data

Nov. 30, 2007 (JP) ..... 2007-309723

(51) Int. Cl.
*B41J 2/165* (2006.01)
*B41J 29/393* (2006.01)

(52) U.S. Cl. ..... 347/22; 347/19

(58) Field of Classification Search ..... 347/22
See application file for complete search history.

(56) References Cited

U.S. PATENT DOCUMENTS 5,353,052 A 10/1994 Suzuki et al.
6,000,776 A 12/1999 Suzuki et al.
6,305,771 B1 * 10/2001 Jang ..... 347/3
6,959,978 B2 * 11/2005 Chang ..... 347/33
2003/0160837 A1 * 8/2003 Adkins et al. ..... 347/19
2004/0027411 A1 2/2004 Chang

FOREIGN PATENT DOCUMENTS

JP 04-040164 2/1992
JP 2001162835 A * 6/2001
JP 2006-187979 7/2006
JP 2007088919 A * 4/2007

OTHER PUBLICATIONS

Notice of Reasons for Rejection for corresponding Japanese Patent Application No. 2007-309723 mailed on Jun. 22, 2010.

* cited by examiner

*Primary Examiner* — Shelby Fidler
(74) *Attorney, Agent, or Firm* — Banner & Witcoff, Ltd.

(57) ABSTRACT

An inkjet recording apparatus comprises a conveying section having a conveying surface configured to convey a recording medium. The inkjet recording apparatus further comprises an inkjet head having a discharge surface. The inkjet recording apparatus further comprises a maintenance unit configured to maintain the inkjet head and a maintenance-unit moving mechanism configured to move the maintenance unit between a maintenance position and a withdrawal position. The inkjet recording apparatus further comprises an image sensor capable of picking up an image on the recording medium or on the conveying surface. The image sensor has a reading surface that opposes the conveying surface. The inkjet recording apparatus further comprises a cleaning member secured to the maintenance unit and configured to clean the reading surface. The inkjet recording apparatus further comprises an image-sensor moving mechanism configured to move the image sensor between an image pickup position and a cleaning position.

14 Claims, 11 Drawing Sheets

INKJET RECORDING APPARATUS HAVING CLEANING MEMBER FOR CLEANING AN IMAGE SENSOR

CROSS REFERENCE TO RELATED APPLICATION

This application claims priority to Japanese Patent application No. 2007-309723, filed Nov. 30, 2007, the entire subject matter and disclosure of which is incorporated herein by reference.

BACKGROUND

1. Technical Field

The features herein relate to an inkjet recording apparatus that records an image on a recording medium by discharging ink. More particularly, the present invention relates to an inkjet recording apparatus including an image sensor that picks up a recorded image.

2. Description of the Related Art

A known inkjet recording apparatus includes a line image sensor that reads a chart printed on a recording medium at a position adjacent to a downstream side of a line head in a conveying direction. Any nozzle improperly discharging ink in the line head is detected from image data obtained by the line image sensor. Therefore, even if any nozzle improperly discharging ink exists, a predetermined supplementary operation is performed to prevent considerable deterioration of image quality.

A glass surface, which is a reading surface, of the reader used in the inkjet recording apparatus in this example is always exposed to suspended mist of the ink. When the glass surface becomes dirty due to foreign matter, such as ink mist, adhering to the glass surface, an image cannot be accurately read. This may result in erroneous detection.

Accordingly, in the inkjet recording apparatus in this example, when the glass surface is dirty, the reader is moved upward, and a cleaning blade that has been moved to a location below the glass surface in a sheet conveying direction is slid along the glass surface in a longitudinal direction of the reader to remove the ink mist adhered to the glass surface. However, in this example, a mechanism for raising and lowering the reader and a mechanism for moving the cleaning blade in two orthogonal directions are required. This causes the apparatus to become sophisticated and large.

SUMMARY

According to an aspect of the invention, an inkjet recording apparatus may comprise a conveying section having a conveying surface that is configured to convey a recording medium in a conveying direction. The inkjet recording apparatus may further comprise an inkjet head having a discharge surface that has a discharge port and that opposes the conveying surface. The discharge port may be configured to discharge ink. The inkjet recording apparatus may comprise a maintenance unit configured to maintain the inkjet head, and a maintenance-unit moving mechanism configured to move the maintenance unit between a maintenance position, where the maintenance unit opposes the discharge surface, and a withdrawal position, where the maintenance unit does not oppose the discharge surface. An inkjet recording apparatus may further comprise an image sensor capable of picking up an image on a surface of the recording medium conveyed by the conveying section or on the conveying surface. The image sensor may have a reading surface that opposes the conveying surface. The inkjet recording apparatus may comprise a cleaning member secured to the maintenance unit and configured to clean the reading surface. The inkjet recording apparatus may further comprise an image-sensor moving mechanism configured to move the image sensor between an image pickup position, where the image sensor is capable of picking up the image on the surface of the recording medium or on the conveying surface, and a cleaning position, where the cleaning member is capable of cleaning the reading surface. The inkjet recording apparatus may further comprise a controller that controls the image-sensor moving mechanism so that the image sensor moves to the cleaning position, and controls the maintenance-unit moving mechanism so that the cleaning member cleans the reading surface as a result of moving the maintenance unit.

According to an aspect of the invention, an inkjet recording apparatus may comprise a conveying section having a conveying surface that conveys a recording medium in a conveying direction. The inkjet recording apparatus may further comprise an inkjet head having a discharge surface that has a discharge port and that opposes the conveying surface. The discharge port may discharge ink. The inkjet recording apparatus may comprise an image sensor capable of picking up an image on a surface of the recording medium conveyed by the conveying section or on the conveying surface. The image sensor may have a reading surface that opposes the conveying surface. The inkjet recording apparatus may comprise a housing containing the conveying section, the inkjet head, and the image sensor. The housing may have a body that has an opening that allows the image sensor to be exposed the outside, and a door that is supported by the body and capable of covering the opening and of being removed from the opening. The inkjet recording apparatus may comprise an image-sensor moving mechanism accommodated in the body and configured to move the image sensor between an image pickup position, where the image sensor is capable of picking up the image on the surface of the recording medium or on the conveying surface, and an exposure position, where the reading surface is capable of being exposed to the outside from the opening.

According to an aspect of the invention, an inkjet recording apparatus may comprise a conveying section having a conveying surface that conveys a recording medium in a conveying direction. The inkjet recording apparatus may further comprise an inkjet head having a discharge surface that has a discharge port and that opposes the conveying surface. The discharge port may discharge ink. The inkjet recording apparatus may comprise an image sensor capable of picking up an image on a surface of the recording medium conveyed by the conveying section or on the conveying surface. The image sensor may have a reading surface that opposes the conveying surface. The inkjet recording apparatus may comprise a housing containing the conveying section, the inkjet head, and the image sensor. The housing may have a body that has an opening that allows the image sensor to be exposed the outside, and a door that is supported by the body and capable of covering the opening and of being removed from the opening. The inkjet recording apparatus may comprise a conveying-section moving mechanism accommodated in the body and configured to move the conveying section between a conveying position, where the conveying section conveys the recording medium, and an exposure position, where the recording surface is capable of being exposed to the outside from the opening.

According to an aspect of the invention, an inkjet recording apparatus may comprise a conveying section having a conveying surface that is configured to convey a recording medium in a conveying direction. The inkjet recording apparatus may further comprise an inkjet head having a discharge surface that has a discharge port and that opposes the conveying surface. The discharge port may be configured to discharge ink. The inkjet recording apparatus may comprise a maintenance unit configured to maintain the inkjet head, and a maintenance-unit moving mechanism configured to move the maintenance unit between a maintenance position, where the maintenance unit opposes the discharge surface, and a withdrawal position, where the maintenance unit does not oppose the discharge surface. An inkjet recording apparatus may further comprise an image sensor capable of picking up an image on a surface of the recording medium conveyed by the conveying section or on the conveying surface. The image sensor may have a reading surface that opposes the conveying surface. The inkjet recording apparatus may comprise a cleaning member secured to the maintenance unit and configured to clean the reading surface. The inkjet recording apparatus may further comprise an image-sensor moving mechanism configured to move the image sensor between an image pickup position, where the image sensor is capable of picking up the image on the surface of the recording medium or on the conveying surface, and a cleaning position, where the cleaning member is capable of cleaning the reading surface.

DESCRIPTION OF THE PREFERRED EMBODIMENTS

It is noted that various connections are set forth between elements in the following description. It is noted that these connections in general and, unless specified otherwise, may be direct or indirect and that this specification is not intended to be limiting in this respect.

First Embodiment

Schematic Structure of Printer

Figure 1:
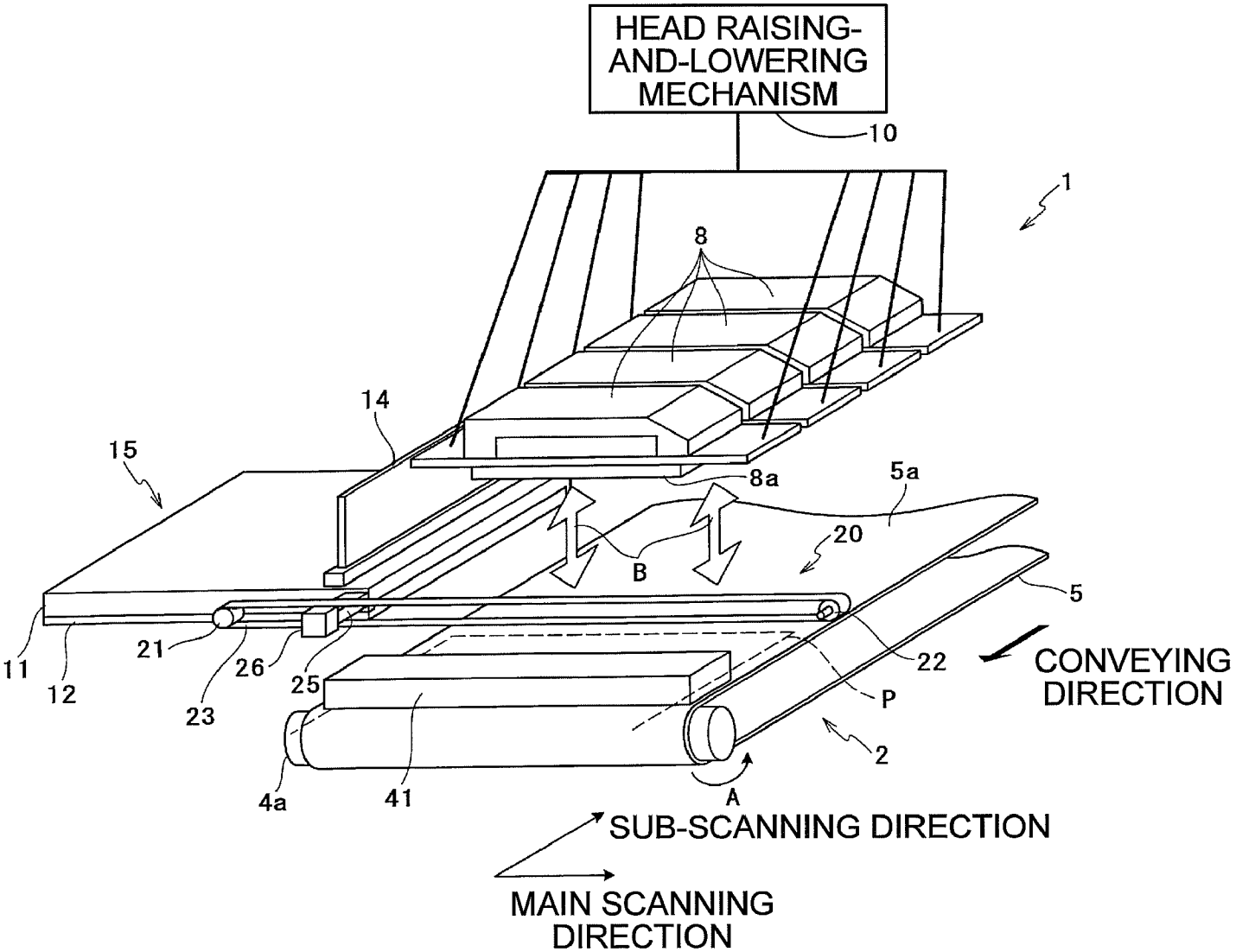
FIG. 1 is a schematic structural view of an inkjet printer according to a first embodiment of the present invention.
Figure 2:
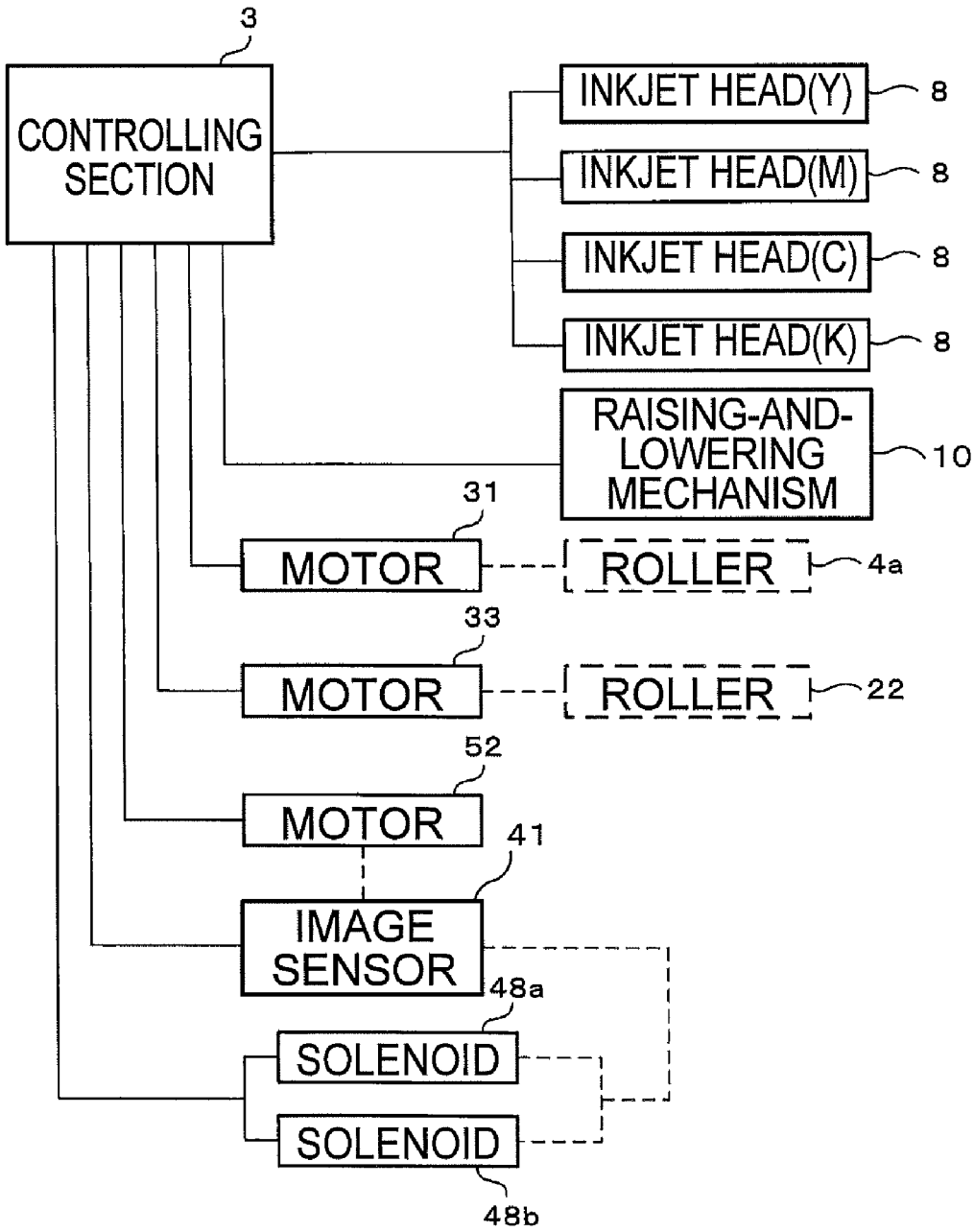
FIG. 2 is a block diagram of a controlling system of the inkjet printer shown in FIG. 1.

Referring to FIG. 1 and FIG. 2, the inkjet printer 1 (hereunder simply referred to as "printer") comprises a conveying mechanism 2 that conveys a print sheet P and a controlling section 3 that controls the operation of the printer 1.

The conveying mechanism 2 includes a pair of belt rollers. FIG. 1 only shows a belt roller 4*a* of the two belt rollers. The other belt roller 4*b* (see FIG. 6) is horizontally disposed apart from the belt roller 4*a* shown in FIG. 1 along a sub-scanning direction. The two belt rollers 4*a* and 4*b* are long in a main scanning direction. The belt roller 4*a* is driven by a driving device (not shown) including a motor 31 and is rotated in the direction of arrow A shown in FIG. 1. The belt roller 4*b* is a driven roller.

In the specification, the sub-scanning direction is in the same direction as a direction in which a print sheet is conveyed by the conveying mechanism 2. The main scanning direction is perpendicular to the sub-scanning direction and is along a horizontal plane (the left-right direction in FIG. 1).

The controlling section 3 includes a central processing unit (CPU), which is a processing unit; read only memory (ROM) that stores a control program executed by the CPU and data used in the control program; and random access memory (RAM) which temporarily stores the data when the program is executed.

A conveying belt 5 is an endless belt that is wound upon the two belt rollers 4*a* and 4*b*. The conveying belt 5 rotates as the belt rollers 4*a* and 4*b* rotate. An upwardly facing portion of an outer peripheral surface of the conveying belt 5 operates as a conveying surface 5*a* that conveys a print sheet P in the conveying direction.

In the printer 1, four inkjet heads 8 are secured. Each inkjet head 8 schematically has a long rectangular shape in the main scanning direction in plan view. That is, each inkjet head 8 is a line inkjet head. The four inkjet heads 8 are disposed at corresponding positions in both the up-down direction and the main scanning direction, and are disposed apart from each other at equal intervals in the sub-scanning direction.

Nozzle surfaces 8*a* or ink discharge surfaces are provided at the lower surfaces of the inkjet heads 8. The nozzle surfaces 8*a* have a plurality of ink discharge ports. The nozzles surfaces 8*a* have flat surfaces except where the plurality of discharge openings are formed, and are parallel to and oppose the conveying surface 5*a* of the conveying belt 5. A plurality of individual ink flow paths are formed in the interior of the inkjet heads 8. One end of each individual ink flow path has a discharge port in the corresponding nozzle surface 8*a*. The other end of each individual ink flow path is connected to a common ink chamber which stores ink. The common ink chamber is connected to a flow path having at one end an ink supply port (not shown) formed in the upper surface of each inkjet head 8. The ink flow ports are connected to ink tanks (not shown) that store ink of different colors with each inkjet head 8.

When a print sheet P that is conveyed by the conveying belt 5 opposes the nozzle surfaces 8*a* of the four inkjet heads 8, ink is discharged from the nozzle surfaces 8*a* on the basis of a command from the controlling section 3, to form a predetermined color image on the surface of the print sheet P. On the basis of the command from the controlling section 3, the four inkjet heads 8 print a test pattern on the conveying surface 5*a* of the belt 5 or the print sheet P. In the embodiment, printing of a test pattern is carried out for a predetermined number of sheets each time printing is completed.

Both ends of each inkjet head 8 is secured to a head raising-and-lowering mechanism 10. The head raising-and-lowering mechanism 10 is moved in the up-down direction (directions of double-headed arrows B), to change the distance between the conveying surface 5*a* of the conveying belt 5 and the nozzle surfaces 8*a*.

A moving table 11 and a securing table 12, each of which has a horizontal upper surface, are disposed at a side of the conveying mechanism 2. The moving table 11 supports a wiper blade 14. In addition, the moving table 11 also operates as a plate that receives ink purged from the heads 8 during a maintenance operation. The wiper blade 14 is a rectangular member whose long side extends in the sub-scanning direction, and is formed of rubber, which is an elastic material. The securing table 12 is a flat member secured to a frame (not shown). In the embodiment, the moving table 11, the securing table 12, and the wiper blade 14 constitute a maintenance unit 15.

A pair of rollers 21 and 22 are mounted to the frame (not shown). The pair of rollers 21 and 22 are disposed at substantially the same height as the moving table 11, and can rotate around central axes thereof extending in the sub-scanning direction. The roller 22 is rotationally driven in both directions by a motor 33. A belt 23 is wound upon the two rollers 21 and 22 so that the two rollers 21 and 22 are positioned at respective ends of the belt 23.

A supporting portion 25 extending in the sub-scanning direction protrudes from a side surface of the moving table 11. A sponge 26, serving as a cleaning member, is mounted to an end of the supporting portion 25. The upper surface of the supporting portion 25 is secured to the lower surface of the upper portion of the belt 23. Therefore, as the belt 23 moves, the supporting portion 25, the sponge 26, and the moving table 11 can reciprocate together in the main scanning direction. The rollers 21 and 22, the belt 23, the motor 33, the supporting portion 25, etc., constitute a moving-table driving mechanism 20 serving as a maintenance-unit moving mechanism.

The moving-table driving mechanism 20 reciprocates the moving table 11 between a withdrawal position, opposing the securing table 12, and a maintenance position, opposing each nozzle surface 8*a*. When each head 8 is held at a cleaning height by the head raising-and-lowering mechanism 10, the reciprocating movement causes the wiper blade 14, secured to the upper surface of the moving table 11, to wipe the nozzle surfaces 8*a*, thereby removing foreign matter, such as ink, adhered to the nozzle surfaces 8*a*.

Image Sensor

An image sensor 41 is disposed further downstream from the four inkjet heads 8 in the conveying direction. A reading surface 41*a*, which is a lower surface of the image sensor 41, opposes the conveying surface 5*a* of the conveying belt 5. The reading surface 41*a* is slightly spaced from the conveying surface 5*a*. In addition, the reading surface 4*a* is long in the main scanning direction. That is, the image sensor 41 is a line sensor. An image pickup range of the image sensor, that is, the range of existence of the reading surface 41*a* is the same as a printable range of each inkjet head 8 in the main scanning direction.

The image sensor 41 picks up the test pattern printed on the print sheet P or the conveying surface 5*a* of the belt 5 by the heads 8 on the basis of the command from the controlling section 3. Image data obtained by the pickup operation is transmitted to the controlling section 3. Then, on the basis of the image data, the controlling section 3 determines whether or not ink from the heads 8 is improperly discharged. The image data obtained as a result of the pickup operation performed on the print sheet P by the image sensor 41 may be used for detecting the position of the sheet P that is conveyed by the conveying belt 5. When the controlling section 3 determines that the ink from the heads 8 is not properly discharged, as mentioned below, maintenance is performed on the heads 8.

Figure 3A:
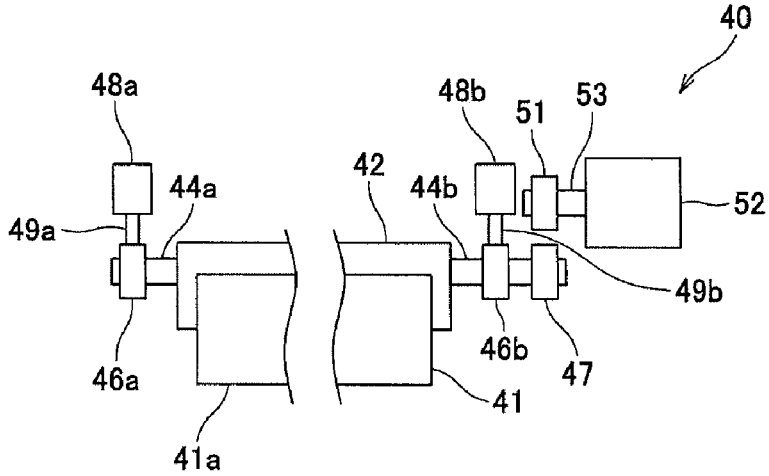
FIGS. 3A to 3D are schematic views of the structure and the operation of an image-sensor moving mechanism.

As shown in FIG. 3A, the image sensor 41 is supported by a holder 42 by fitting the upper half of the image sensor 41 to the holder 42. Shafts 44*a* and 44*b* protrude from respective longitudinal ends of the holder 42. The shafts 44*a* and 44*b* are inserted into respective circular cylindrical supporting members 46*a* and 46*b*. The shaft 44*b* is also inserted into a gear 47. The gear 47 is positioned outward from the supporting member 46*b*.

Solenoids 48*a* and 48*b* having downwardly extending plunger rods 49*a* and 49*b* are disposed above the respective supporting members 46*a* and 46*b*. The amounts of protrusions of the plunger rods 49*a* and 49*b* are controlled as being either large or small on the basis of a command from the controlling section 3. The plungers 49*a* and 49*b* are secured to the respective supporting members 46*a* and 46*b* at one end. A gear 51 is disposed above the gear 47. The gear 51 is rotatably supported to a shaft 53 that is rotationally driven by a motor 52. The motor 52 rotates on the basis of a command from the controlling section 3.

Figure 3B:
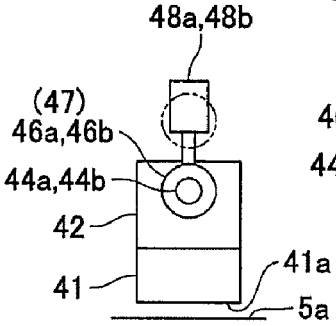

When the protrusion amounts of the plunger rods 49*a* and 49*b* are large, the gear 47 and the gear 51 are separated from each other as shown in FIGS. 3A and 3B. At this time, the reading surface 41*a* of the image sensor 41 is at a height suitable for picking up the test pattern printed on the print sheet P or the conveying surface 5*a* of the belt 5, that is, at a height (image pickup position) where an object image is focused on an image pickup element of the image sensor 41.

In contrast, when the protrusion amounts of the plunger rods 49*a* and 49*b* are small, the image sensor 41 is displaced upward, so that the reading surface 41*a* moves away from the conveying surface 5*a* than the image pickup position. Then, the gear 47 and the gear 51 engage each other, so that the rotation of the gear 51 is transmitted to the gear 47. Therefore, by driving the motor 52 when the protrusions amounts of the plunger rods 49*a* and 49*b* are small, the shafts 44*a* and 44*b* are rotated, so that the reading surface 41*a* of the image sensor 41 is set vertically as shown in FIG. 3B. The position of the image sensor 41 at this time is called a cleaning position. The reading surface 41*a* of the image sensor 41 at the cleaning position is in contact with the sponge 26. In the embodiment, members other than the image sensor 41 shown in FIG. 3A, that is, the solenoids 48*a* and 48*b*, the gear 47, etc., constitute an image-sensor moving mechanism 40.

Printer Operation

Figure 4:
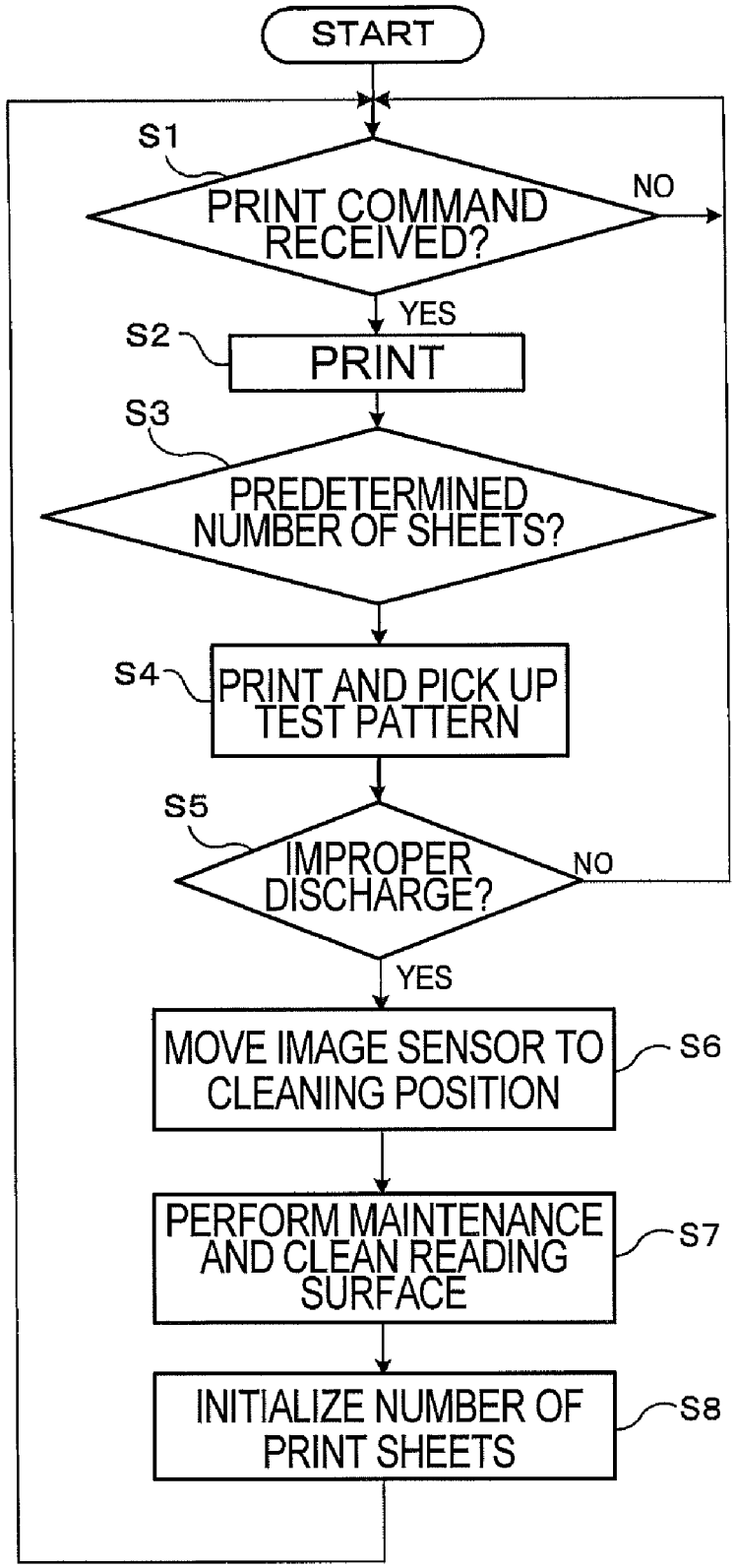
FIG. 4 is a flowchart of the operation of the inkjet printer shown in FIG. 1.

Next, the operation of the printer 1 according to the embodiment will be described on the basis of the flowchart of FIG. 4. First, in Step S1, the controller section 3 determines whether or not the printer 1 has received a print command from a host computer (not shown). The print command includes print data regarding an image that a user wants to print.

When the printer 1 has received the print command, the process proceeds to Step S2 to print an image on a print sheet P. The printing carried out in Step S2 is continuously performed for the number of sheets associated with the print command received in Step S1.

Next, in Step S3, the controlling section 3 determines whether or not the number of sheets whose printing has been completed and which has been counted by a counter (not shown) of the controlling section 3 is greater than or equal to a predetermined number of sheets. If the number of sheets is less than the predetermined number of sheets (S3: NO), the process returns to Step S1. If it is greater than the predetermined number of sheets (S3: YES), the process proceeds to Step S4. In Step S4, on the basis of a command from the controlling section 3, a test pattern is printed onto a print sheet P or the conveying surface 5*a*, and the test pattern is picked up by the image sensor 41. Here, the image sensor 41 is at the image pickup position shown in FIG. 5A.

In Step S5, on the basis of image data obtained from the result of the image pickup by the image sensor 41, the controlling section 3 determines whether or not there is improper ink discharge from the four heads 8 (including no ink discharge, improper discharge amount, and improper discharge direction). If there is improper discharge (S5: NO), the process returns to Step S1. If there is improper discharge (S5: YES), the process proceeds to Step S6.

Figure 5A:
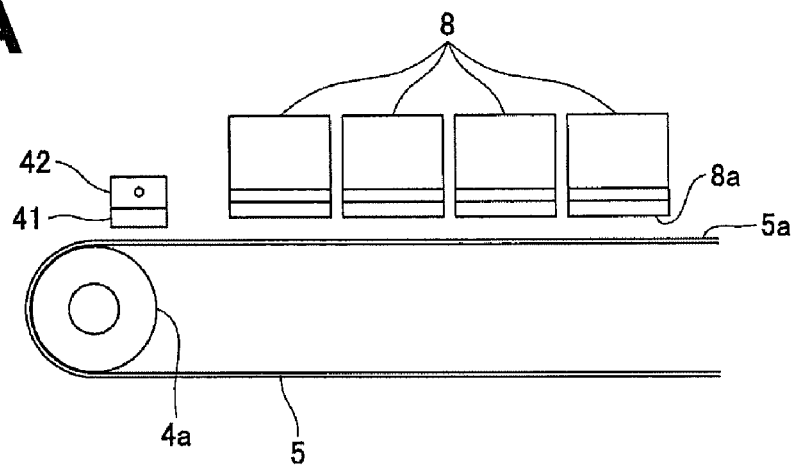
FIGS. 5A and 5B are aide views showing the relationship between a cleaning member and a reading surface of an image sensor in the inkjet printer shown in FIG. 1.

In Step S6, on the basis of a command from the controlling section 3, the image-sensor moving mechanism 40 moves the image sensor 41 from the image pickup position shown in FIG. 5A to the cleaning position. That is, the image-sensor moving mechanism 40 displaces the image sensor 41 upward, and, then, rotates the image sensor 41 by 90 degrees around the shafts 44*a* and 44*b* as centers so that the reading surface 41*a* faces the heads, that is, the upstream side in the conveying direction.

Figure 5B:
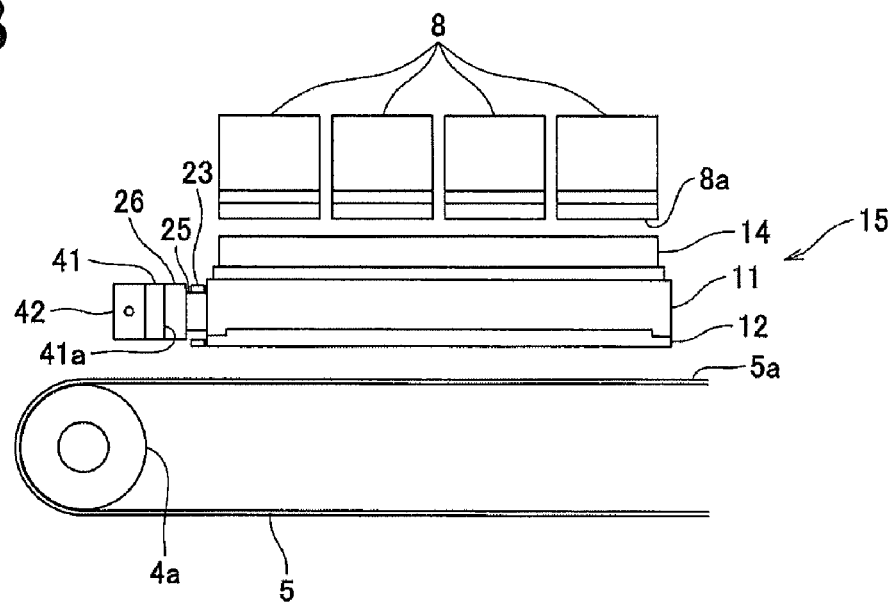

In Step S7, on the basis of a command from the controlling section 3, the head raising-and-lowering mechanism 10 raises the heads 8 from a printing height to a cleaning height. Then, on the basis of a command from the controlling section 3, the moving-table driving mechanism 20 moves the moving table 11 from the withdrawal position to the maintenance position along the main scanning direction. That is, the motor 33 rotates the roller 22 to move the moving table 11 below the heads 8 in the main scanning direction. At this time, as shown in FIG. 5B, the sponge 26, which is a cleaning member, moves in the main scanning direction while the sponge 26 contacts the reading surface 41*a* of the image sensor 41. Therefore, foreign matter, such as ink, adhered to the reading surface 41*a* is removed.

Further, on the basis of a command from the controlling section 3, after performing a purging operation in which a pressure pump (not shown) is used to forcefully discharge the ink from the heads 8 to the moving table 11, the moving-table driving mechanism 20 moves the moving table 11 from the maintenance position to the withdrawal position along the main scanning direction. At this time, the wiper blade 14 wipes the nozzle surfaces 8*a* to which ink is adhered by the purging, to remove foreign matter, such as the ink, adhered to the nozzle surfaces 8*a*. At the same time, foreign matter, such as ink, adhered to the reading surface 41*a* is also removed because the sponge 26 in contact with the reading surface 41*a* of the image sensor 41 moves along the main scanning direction.

When, in Step S7, a maintenance operation is completed, in Step S8, the number of sheets whose printing has been completed and which has been counted by the counter is initialized, and the process returns to Step S1.

In the inkjet printer 1 according to the embodiment described above, the sponge 26, which is a cleaning member, is secured to the maintenance unit 15. The image-sensor moving mechanism 40 can move the image sensor 41 to the cleaning position where the reading surface 41*a* thereof contacts the sponge 26. Therefore, only moving the maintenance unit 15 in the main scanning direction makes it possible to remove foreign matter, such as ink, adhered to the reading surface 41*a* with the sponge 26. Therefore, it is no longer necessary to provide a moving mechanism that moves the cleaning member along with the moving-table driving mechanism 20. Therefore, the number of parts is reduced, and the structure of the inkjet printer 1 is simplified.

Although, here, the heights of the heads 8 in both reciprocation movements of the moving table 11 are the same, the present invention is not limited thereto. Therefore, the heights of the heads 8 during the forward movement may be set higher than that in the return movement, so that the nozzle surfaces 8*a* may be positioned so as not to contact the wiper blade 14 during the forward movement.

In the embodiment, since the sponge 26 moves in the main scanning direction, which is a longitudinal direction of the reading surface 41*a*, the sponge 26 can be made relatively small.

Since the image sensor 41 is rotated after it is moved in a direction in which it moves away from the conveying surface 5*a*, that is, after it is moved upward, the image sensor 41 can be moved to the cleaning position without contacting the reading surface 41*a* with the conveying surface 5*a*.

Although, in the embodiment, the image sensor 41 is rotated after it is raised, the cleaning member which has been moved in the main scanning direction may be brought into contact with the reading surface 41*a* without raising the image sensor 41 and, then, rotating the image sensor 41. In this case, it is necessary to substantially match the height of the upper surface of the cleaning member with the height of the reading surface 41*a* after raising the image sensor 41, and to match the position of the cleaning member with the position of the reading surface 41*a* in the sub-scanning direction. Accordingly, the number of parts is further reduced, and the structure of the inkjet printer 1 can be made simpler.

Although, in the embodiment, the image sensor 41 is rotated by 90 degrees around the shafts 44*a* and 44*b* as centers after raising the image sensor 41, it is possible to rotate the image sensor 41 by 180 degrees after raising the image sensor 41, and to contact the cleaning member that has been moving in the main scanning direction with the reading surface 41*a*. In this case, it is necessary to substantially match the height of the lower surface of the cleaning member with the height of the reading surface 41*a* after the rotation of the image sensor 41, and to match the position of the cleaning member with the position of the reading surface 41*a* after rotating the image sensor 41 in the sub-scanning direction.

Second Embodiment

Next, an inkjet printer according to a second embodiment of the present invention will be described with reference to FIGS. 6 and 7. In the second embodiment, parts corresponding to those in the first embodiment will be given the same reference numerals, and will not be described below.

Figure 6:
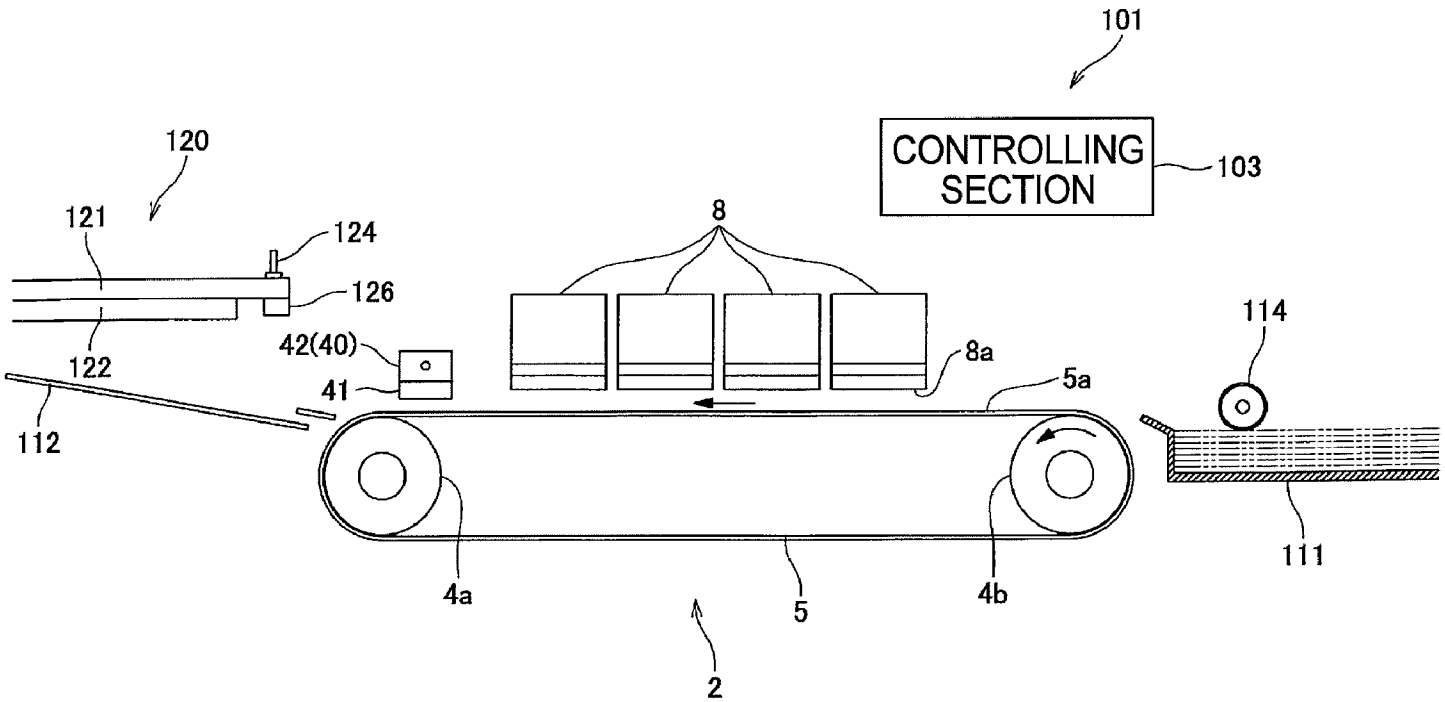
FIG. 6 is a side view of an inkjet printer according to a second embodiment of the invention.

Referring to FIG. 6, in the printer 101, a conveying belt 5 wound upon two belt rollers 4*a* and 4*b* has a conveying surface 5*a* opposing nozzle surfaces 8*a* of inkjet heads 8. A print sheet P that is placed on a conveying mechanism 2 and a conveying surface 5*a* is conveyed from right to left in FIG. 6. A plurality of print sheets P are stacked upon each other in a sheet-feed cassette 111 disposed upstream from the conveying mechanism 2 in a conveying direction. The one topmost print sheet P among the plurality of print sheets P is sent out onto the conveying surface 5*a* of the conveying belt 5 as a pickup roller 114 rotates. Then, the print sheet P on which printing has been performed by the four heads 8 is discharged onto a sheet-discharge tray 112 disposed downstream from the conveying mechanism 2 in the conveying direction. The four heads 8 can be raised and lowered by a head raising-and-lowering mechanism similar to that described in the first embodiment. Various operations of the inkjet printer 100 are controlled by a controlling section 103.

In the embodiment, a maintenance unit 120 includes a moving table 121, a securing table 122, and a wiper blade 124. The moving table 121 can reciprocate between a withdrawal position shown in FIG. 6 (that is, a position where the moving table 121 does not oppose the nozzle surfaces 8*a*) and a maintenance position (see FIG. 7B) where the moving table 121 opposes the nozzle surfaces 8*a*. A moving-table driving mechanism for reciprocating the moving table 121 is the same as the moving-table driving mechanism 20 described in the first embodiment except in the direction of movement. Therefore, the moving-table driving mechanism 20 will not be described below.

A sponge 126, serving as a cleaning member, is mounted to the lower surface of the moving table 121 so as to be disposed below a wiper blade 124. The wiper blade 124 and the sponge 26 are formed long in a main scanning direction so as to have lengths that are the same as that of a printable range of the heads 8.

An image sensor 41 is disposed downstream from the four inkjet heads 8 along the conveying direction. A reading surface 41*a*, which is the lower surface of the image sensor 41, opposes the conveying surface 5*a* of the conveying belt 5. The reading surface 41*a* is formed long in the main scanning direction. The image sensor 41 can be raised and lowered, and rotated by an image-sensor moving mechanism 40 similar to that described in the first embodiment.

Next, the operation of the printer 101 according to the embodiment will be described focusing on the operations of the image sensor 41 and the maintenance unit 120. As in the first embodiment, when a controlling section 103 determines that the number of print sheets is greater than or equal to a predetermined number of sheets, a test pattern is printed onto the conveying surface 5*a* or a print sheet P and the test pattern is picked up by the image sensor 41 on the basis of a command from the controlling section 103. At this time, the image sensor 41 is at the image pickup position shown in FIG. 6.

Figure 7A:
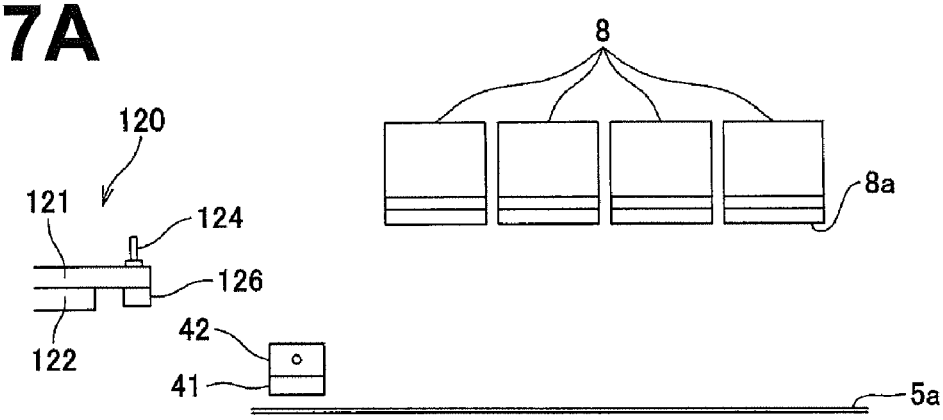
FIGS. 7A to 7C are side views showing the relationship between a cleaning member and a reading surface of an image sensor in the inkjet printer shown in FIG. 6.

On the basis of image data obtained from the result of the image pickup by the image sensor 41, the controlling section 3 determines whether or not there is improper ink discharge from the four heads 8 (including no ink discharge, improper discharge amount, and improper discharge direction). If there is improper discharge, the head raising-and-lowering mechanism is raised from the printing height to the withdrawal height on the basis of a command from the controlling section 103. The state at this time is shown in FIG. 7A.

Then, the moving-table driving mechanism moves the moving table 121 from the withdrawal position to the maintenance position (shown in FIG. 7B) in a sub-scanning direction on the basis of a command from the controlling section 103. This moves the moving table 121 below the heads 8. During the movement, the wiper blade 124 does not contact the nozzle surfaces 8*a*.

Figure 7B:
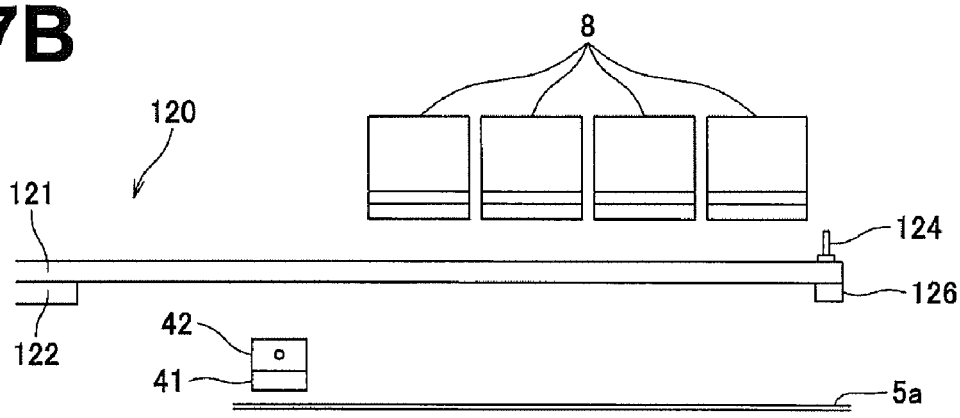

In the state shown in FIG. 7B, on the basis of a command from the controlling section 103, a purging operation in which a pressure pump (not shown) is used to forcefully discharge ink from the heads 8 to the moving table 121 is performed. Then, on the basis of a command from the controlling section 103, the image-sensor moving mechanism 40 moves the image sensor 41 from the image pickup position shown in FIG. 7B to a cleaning position shown in FIG. 7C. That is, the image-sensor moving mechanism 40 displaces the image sensor 41 upward, and, then, rotates the image sensor 41 by 180 degrees so that the reading surface 41*a* faces a side opposite to the conveying surface 5*a*, that is, so that it faces upward.

Figure 7C:
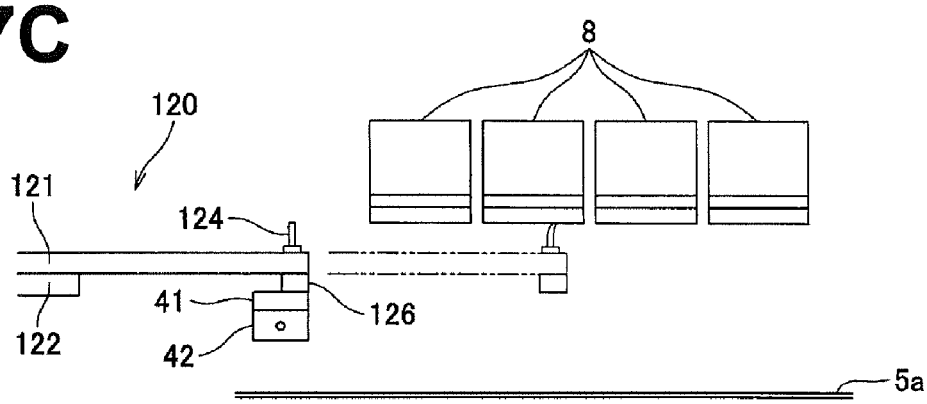

Thereafter, on the basis of a command from the controlling section 103, the moving-table driving mechanism moves the moving table 121 from the maintenance position to the withdrawal position in the sub-scanning direction. At this time, the wiper blade 124 wipes the nozzle surfaces 8*a* to which foreign matter, such as ink, is adhered by the purging, to completely remove foreign matter, such as the ink, adhered to the nozzle surfaces 8*a*. Then, when moving the moving table 121 from the maintenance position to the withdrawal position, as shown in FIG. 7C, the sponge 126, serving as the cleaning member, in contact with the reading surface 41*a* of the image sensor 41 moves in the sub-scanning direction. Therefore, foreign matter, such as ink, adhered to the reading surface 41*a* is removed.

In the inkjet printer 101 according to the embodiment described above, the sponge 126, which is a cleaning member, is secured to the maintenance unit 120. In addition, the image-sensor moving mechanism 40 can move the image sensor 41 to the cleaning position where the reading surface 41*a* thereof contacts the sponge 126. Therefore, only moving the maintenance unit 120 in the sub-scanning direction makes it possible to remove foreign matter, such as ink, adhered to the reading surface 41*a*, with the sponge 126. Therefore, it is no longer necessary to provide a moving mechanism that moves the cleaning member along with the moving-table driving mechanism. Therefore, the number of parts is reduced, and the structure of the inkjet printer 101 is simplified.

In the embodiment, since the sponge 126, serving as a cleaning member, is moved with respect to the reading surface 41*a* that is long in the main scanning direction, the time of cleaning the reading surface 41*a* with the sponge 126 is reduced. Therefore, foreign matter can be removed from the reading surface 41*a* in a relatively short time.

Further, in the embodiment, since the image sensor 41 is rotated after it is moved in a direction in which it moves away from the conveying surface 5*a*, that is, after it is moved upward, the image sensor 41 can be moved to the cleaning position without contacting the reading surface 41*a* with the conveying surface 5*a*.

Third Embodiment

Next, an inkjet printer according to a third embodiment of the present invention will be described with reference to FIGS. 8 and 9. In the third embodiment, corresponding parts to those used in the first and second embodiments are given the same reference numerals, and will not be described below.

Figure 8:
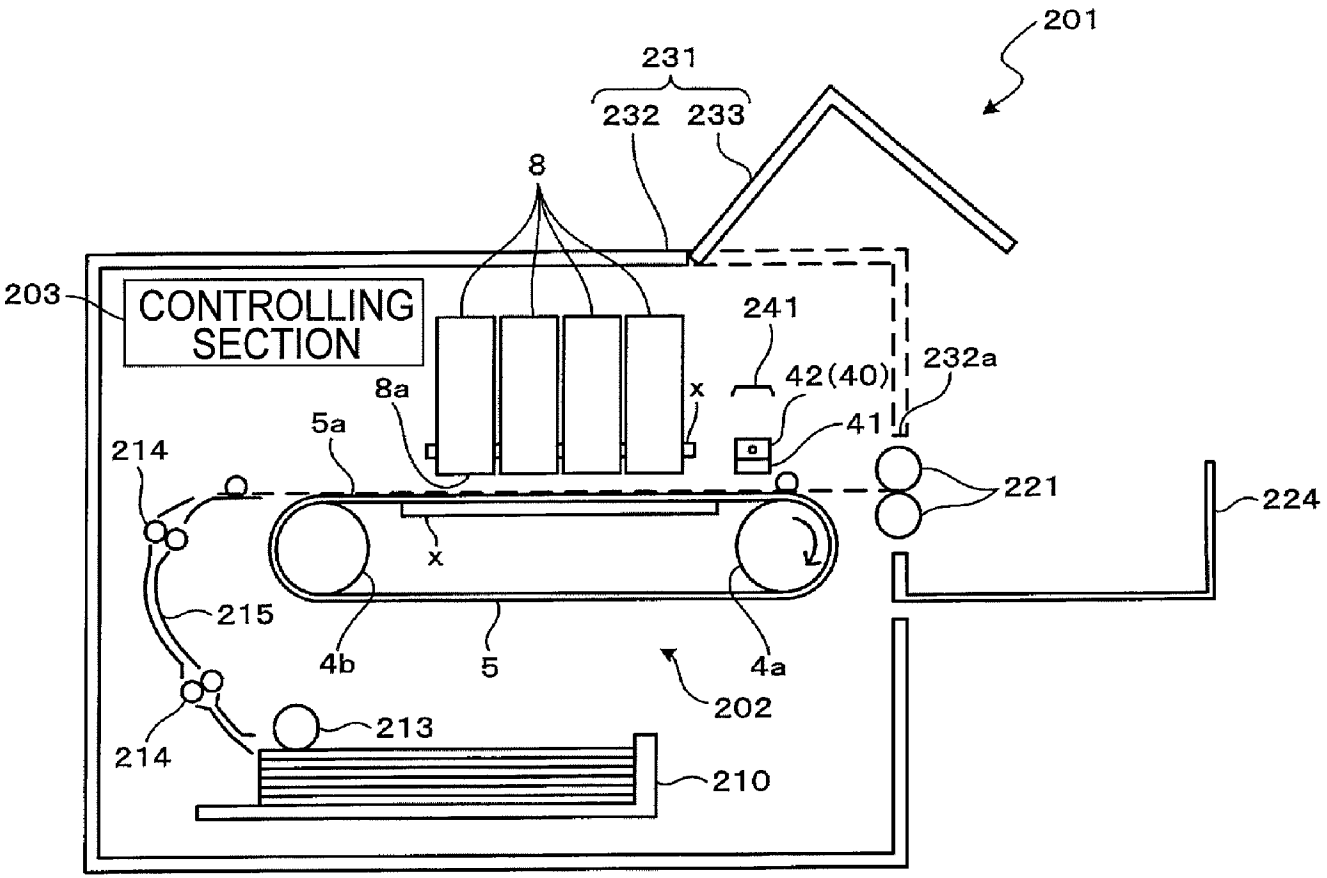
FIG. 8 is a side view of an inkjet printer according to a third embodiment of the invention.

As shown in FIG. 8, the inkjet printer 201 includes four inkjet heads 8. A conveying mechanism 202 that can convey a sheet P while the sheet P opposes nozzle surfaces 8*a* of the inkjet heads 8 is disposed below the inkjet heads 8. Various operations of the inkjet printer 201 are controlled by a controlling section 203.

A sheet-feed tray 210 containing a plurality of sheets P is disposed on a side opposite to the inkjet heads 8 with the conveying mechanism 202 being disposed therebetween, that is, below the conveying mechanism 202. A pickup roller 213 that sends out the topmost sheet P among the plurality of sheets P contained in the sheet-feed tray 210 is provided at the sheet-feed tray 210. The sheet P that has been sent out by the pickup roller 213 is sent to the conveying mechanism 202 by two sheet-feed rollers 214, which convey upward the sheet P while nipping the sheet P, and a sheet-feed guide 215, which guides the sheet P.

A pair of sheet-discharge rollers 221 are disposed downstream from the conveying mechanism 202 in a forward conveying direction. The sheet P that has passed the pair of discharge rollers 221 is discharged onto a sheet-discharge tray 224.

An image sensor 41 and an image-sensor moving mechanism 40 similar to those described in the first embodiment are disposed above a belt roller 4*b*. Further, a cap 241 for covering the reading surface 41*a* of the image sensor 41 is disposed above the image sensor 41.

In the printer 201 according to the third embodiment, the inkjet heads 8, the conveying mechanism 202, the controlling section 203, the image sensor 41, the cap 241, and the sheet-feed tray 210 are accommodated in a housing 231. The sheet-discharge tray 224 is disposed outside the housing 231. The housing 231 comprises two members, that is, a body 232 and a door 233. The body 232 has a substantially rectangular parallelepiped shape and has an opening 232*a* (portions corresponding to the sheet-discharge tray 224 and the pair of sheet-discharge rollers 221). The door 233 has substantially the same shape as the opening 232*a* and is supported by the body 232. The opening 232*a* has an L shape so as to be provided at both a portion corresponding to the upper wall of the body 232 and a portion corresponding to a side wall of the body 232. The opening 232*a* is formed long in a longitudinal direction of the heads 8. The door 233 is swingably mounted to the upper wall of the body 232 so that it can be selectively set in a state in which it covers the opening 232*a* (that is, a state indicated by broken lines in FIG. 8) and in a state in which it is moved away from the opening 232*a* (that is, a state indicated by a solid line in FIG. 8). The states of the door 233 may be manually switched by a user or may be switched using a driving mechanism (not shown) of the door 233 on the basis of a controlling operation by the controlling section 203.

Figure 3C:
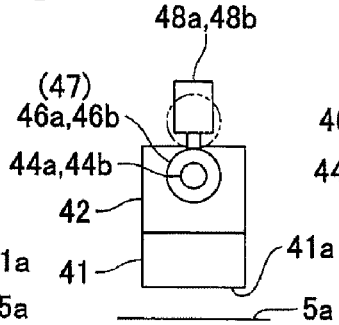
Figure 3D:
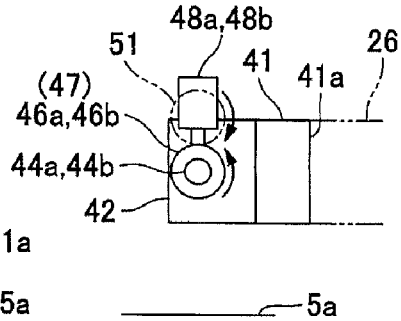

The height of the upper surface of the image sensor 41 is substantially the same as that of the lower edge of the opening 232*a*. The image sensor 41 is positioned in the opening 232*a* in plan view. Members other than the cap 241 are not disposed between the image sensor 41 and the door 233. Therefore, while the door 233 is moved away from the opening 232*a*, the user can visually observe the image sensor 41 through the opening 232*a*. Here, as discussed in the first embodiment, when the image-sensor moving mechanism 40 rotates the image sensor 40 by 90 degrees around shafts 44*a* and 44*b* as centers after it has raised the image sensor 41 upward (see FIGS. 3B, 3C, and 3D), the user can easily manually clean the reading surface 41*a* of the image sensor 41. Therefore, it no longer becomes necessary to provide, for example, a cleaning member or a moving mechanism that moves the cleaning member. Therefore, the number of parts is reduced, and the structure of the inkjet printer 201 is considerably simplified. In the embodiment, the position of the image sensor 41 when the reading surface 41*a* of the image sensor 41 is exposed to the outside of the housing 231 from the opening 232*a* as a result of the reading surface 41*a* of the image sensor 41 being set vertically is called an exposure position. The exposure position may be where the reading surface 41*a* of the image sensor 41 is not set vertically (for example, where the image sensor 41 is rotated by 120 degrees from the state shown in FIG. 3C).

In the embodiment, since both the reading surface 41*a* and the opening 232*a* are long in the longitudinal direction of the heads 8, foreign matter can be easily removed from the reading surface 41*a*, which is advantageous for the user.

Since the image sensor 41 is rotated after it is moved in a direction in which it moves away from a conveying surface 5*a*, that is, after it is moved upward, the image sensor 41 can be moved to the exposure position without contacting the reading surface 41*a* with the conveying surface 5*a*.

Next, the operation performed when covering the reading surface 41*a* of the image sensor 41 with the cap 241 will be described with reference to FIGS. 9A to 9D.

Figure 9D:
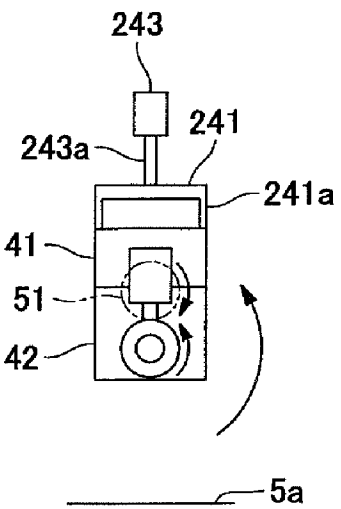
FIGS. 9A to 9D are side views of an image sensor and cap operations shown in order in the inkjet printer shown in FIG. 8.
Figure 9C:
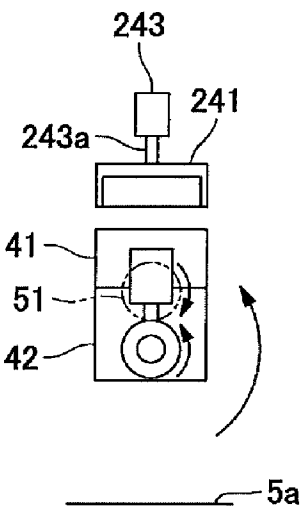
Figure 9B:
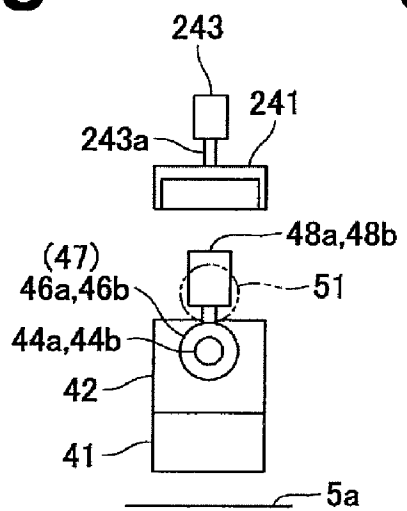
Figure 9A:
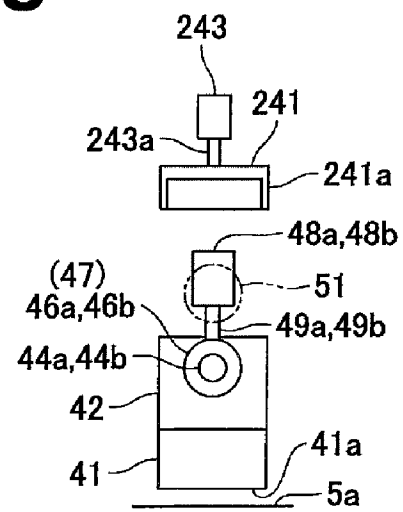

As shown in FIG. 9A, a longitudinal direction of the cap 241 disposed above the image sensor 41 is parallel to the longitudinal direction of the inkjet heads 8. The cap 241 has a shape in which annular protrusions 241*a* protrude downward from peripheral edges of a plate-shaped member having a rectangular flat shape that is of substantially the same size as the reading surface 41*a*. The annular protrusions 241*a* are formed of an elastic material, such as rubber, and have a size and shape corresponding to those of the peripheral edges of the reading surface 41*a*. A solenoid 243 having a downwardly extending plunger rod 243*a* is disposed above the cap 241. The amount of protrusion of the plunger rod 243*a* is controlled as being either large or small on the basis of a command from the controlling section 203. An end of the plunger 243*a* is secured to the back surface of the cap 241.

FIG. 9A shows a state in which the amounts of protrusions of plunger rods 49*a* and 49*b* are large, and in which the amount of protrusion of the plunger rod 243*a* is small. At this time, the reading surface 41*a* of the image sensor 41 is at a height suitable for picking up a test pattern printed on a print sheet P or the conveying surface 5*a* of the belt 5, that is, at a height (image pickup position) where an object image is focused on an image pickup element of the image sensor 41.

When the protrusion amounts of the plunger rods 49*a* and 49*b* are small, as shown in FIG. 9B, the image sensor 41 is displaced upward, so that the reading surface 41*a* moves away from the conveying surface 5*a* than the image pickup position. At this time, by driving a motor 52, as shown in FIG. 9C, the image sensor 41 is rotated by 180 degrees around the shafts 44*a* and 44*b* as centers. This causes the reading surface 41*a* to oppose the cap 241 while being spaced apart from the cap 241 (the position of the image sensor 41 at this time is called a cap position).

When the protrusion amount of the plunger rod 243*a* becomes large, as shown in FIG. 9D, the cap 241 is lowered, so that the annular protrusion 241*a* of the cap 241 comes into contact with the reading surface 41*a*. When the annular protrusions 241*a* and the peripheral edges of the reading surface 41*a* contact each other, a hermetically sealed space is formed in the cap 241. Accordingly, since the cap 241 can cover the reading surface 41*a*, foreign matter, such as ink mist, infrequently adheres to the reading surface 41*a*.

Fourth Embodiment

Figure 10:
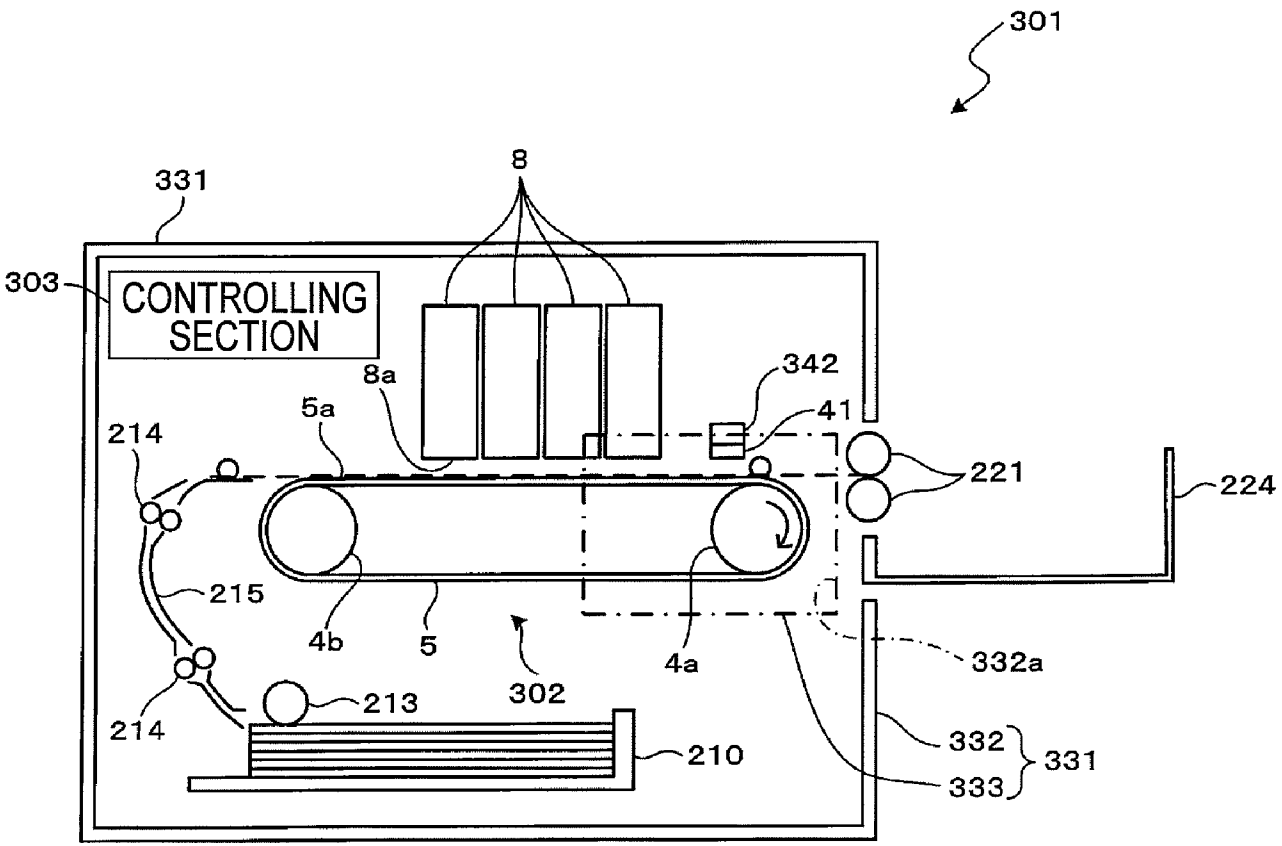
FIG. 10 is a side view of an inkjet printer according to a fourth embodiment of the invention.

Next, an inkjet printer according to a fourth embodiment of the present invention will be described with reference to FIG. 10 and FIGS. 11A and 11B. In the fourth embodiment, corresponding parts to those used in the first to third embodiments are given the same reference numerals, and will not be described below.

The printer 301 according to the fourth embodiment differs mainly from the printer 201 according to the third embodiment as follows:

(1) Position and shape of a door and an opening formed in a housing, (2) Structure of a supporting mechanism of an image sensor, (3) Structure of a conveying mechanism, and (4) Existence or nonexistence of a cap.

The aforementioned items (1) to (4) will be described in turn.

(1) In the fourth embodiment, a housing 331 comprises a substantially rectangular parallelepiped body 332 and a door 333. A substantially rectangular opening 332*a* (indicated by an alternate long and short dash line in FIG. 10) is provided in a side surface of the body 332 in a direction orthogonal to a longitudinal direction of heads 8. The opening 332*a* has a size allowing the entire belt roller 4*a*, the right half of a conveying belt 5, and an image sensor 41 to be exposed. The door 333 has a size that is substantially the same as that of the opening 332*a*, and is supported by the body 332. The door 333 is swingably mounted to a portion near the upper edge of the opening 332*a* of the body 332 so that it can be selectively set in a state in which it covers the opening 332*a* and in a state in which it is removed from the opening 332*a*. The states of the door 333 may be manually switched by a user or may be switched using a driving mechanism (not shown) of the door 333 on the basis of a controlling operation by a controlling section 203 that controls various operation of the inkjet printer 301.

The height of the lower surface of the image sensor 41 is less than that of the upper edge of the opening 332*a*. The image sensor 41 is positioned in the opening 332*a* as viewed from a direction perpendicular to a sheet plane of FIG. 10. Other members are not disposed between the image sensor 41 and the door 333. Therefore, while the door 333 is moved away from the opening 332*a*, the user can visually observe the image sensor 41 through the opening 332*a*.

(2) In the embodiment, the image sensor 41 is secured to a frame (not shown) by a supporting member 342. That is, unlike the first to third embodiments, the image sensor 41 in the fourth embodiment is not raised or lowered or rotated.

Figure 11A:
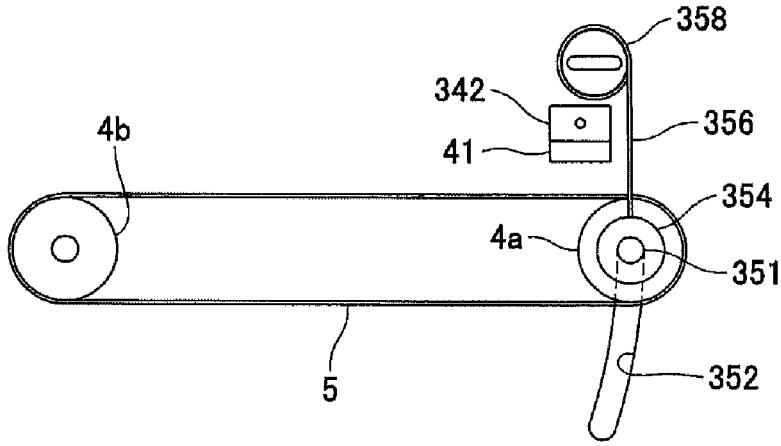
FIGS. 11A and 11B are side views of a conveying-section moving mechanism in the inkjet printer shown in FIG. 10.
Figure 11B:
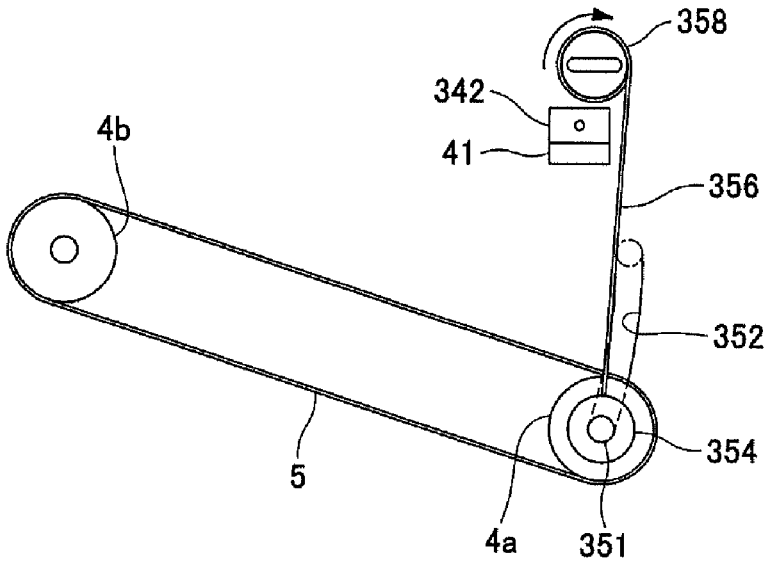

(3) As shown in FIG. 11A, in a conveying mechanism 302, a shaft 351 that supports the belt roller 4*a* is inserted into a long hole 352 provided in a frame (not shown). The long hole 352 has a circular arc shape with a rotational axis of the belt roller 4*b* being a center thereof. The upper edge of the long hole 352 is positioned at substantially the same location as the center of the belt roller 4*b*. As the long hole 352 extends downwards, the long hole 352 curves so as to approach the belt roller 4*b* in a conveying direction. A flange 354 that is concentric with the belt roller 4*a* and has a diameter that is smaller than that of the belt roller 4*a* is mounted to the shaft 351 so as to be separated from the belt roller 4*a*. An end of an elongated soft member 356, such as a wire, a chain, or a string, is secured to the flange 354. The other end of the elongated soft member 356 is secured to the outer peripheral surface of a rotatable handle 358 that is disposed above the supporting member 342 at the image sensor 41.

When a sheet P is conveyed during, for example, printing, the handle 358 is rotated to set a conveying surface 5*a* horizontally. The elongated soft member 356 having a certain length is wound upon the outer peripheral surface of the handle 358. In contrast, when foreign matter is removed from a reading surface 41*a* of the image sensor 41, a user rotates the handle 358 clockwise. As shown in FIG. 11B, this causes the elongated soft member 356 wound upon the outer peripheral surface of the handle 358 to be sent out, and the belt roller 4*a* to be lowered along the long hole 352 by the self weight of the belt roller 4*a*. As a result, a large gap is formed between the reading surface 41*a* of the image sensor 41 and the conveying belt 5. The handle 358 may be rotated by a driving mechanism (not shown) on the basis of a command from the controlling section 303. In the embodiment, the long hole 352, the flange 354, the elongated soft member 356, and the handle 358, etc., constitute a conveying-section moving mechanism. The conveying-section moving mechanism moves the conveying mechanism 302 between a conveying position shown in FIG. 11A and an exposure position shown in FIG. 11B.

(4) Since the image sensor 41 is secured to a frame by the supporting member 342, a cap 241 does not need to be provided in the fourth embodiment as it is in the third embodiment.

In the fourth embodiment, the user can easily manually clean the reading surface 41*a* of the image sensor 41 even if the image sensor is not displaced by an image-sensor moving mechanism due to the aforementioned items (1) and (3). Therefore, it is no longer necessary to provide, for example, a cleaning member or a moving mechanism that moves the cleaning member. This reduces the number of parts, thereby simplifying the structure of the inkjet recording apparatus 201.

Although preferred embodiments of the present invention are described, the present invention is not limited to the above-described embodiments. Various modifications in design may be made in the embodiments within the scope of the claims. For example, although, in the first embodiment, the cleaning of the nozzle surfaces with the wiper blade 14 and the cleaning of the reading surface 41*a* of the image sensor 41 with the sponge 26 are carried out at the same time, they do not need to be carried out the same time. The cleaning of the reading surface 41*a* of the image sensor 41 with the sponge 26 may be carried out independently of whether or not there is improper discharge, such as each time printing on a predetermined number of sheets is completed or immediately after a power supply of the printer is turned on. The maintenance-unit moving mechanism and the image-sensor moving mechanism are merely examples, so that any other structures may be used.

Although, in the third and fourth embodiments, the door is swingably mounted to the body, for example, the door may be removably mounted to the door due to engagement of the door. That is, if the door is supported by the body, the door need not be removably secured to the body.

Further, in yet another embodiment, the image sensor 41 rotates so that the reading surface 41*a* faces away from the heads 8 when rotated to a cleaning position. In this embodiment, the maintenance unit locates the sponge 26 so that the sponge 26 is positioned on an opposite side of the read sensor 41 from the wiper blade 14. At least one advantage of rotating the image sensor 41 to a position where the reading surface 41*a* faces away from the wiper blade 14 is that any material dislodged or removed from the heads 8 has a longer distance to travel before being deposited on the reading surface 41*a* of the read sensor 41 during the cleaning operation.

What is claimed is:

1. An inkjet recording apparatus comprising:

a conveying section having a conveying surface that is configured to convey a recording medium in a conveying direction;

an inkjet head having a discharge surface that has a discharge port and that opposes the conveying surface, the discharge port configured to discharge ink;

a maintenance unit configured to maintain the inkjet head;

a maintenance-unit moving mechanism configured to move the maintenance unit between a maintenance position, where the maintenance unit opposes the discharge surface, and a withdrawal position, where the maintenance unit does not oppose the discharge surface;

an image sensor capable of picking up an image on a surface of the recording medium conveyed by the conveying section or on the conveying surface, the image sensor having a reading surface that opposes the conveying surface;

a cleaning member secured to the maintenance unit and configured to clean the reading surface;

an image-sensor moving mechanism configured to move the image sensor between an image pickup position, where the image sensor is capable of picking up the image on the surface of the recording medium or on the conveying surface, and a cleaning position, where the cleaning member is capable of cleaning the reading surface, wherein the image-sensor moving mechanism is configured to rotate the image sensor; and a controller that controls the image-sensor moving mechanism so that the image sensor moves to the cleaning position, and controls the maintenance-unit moving mechanism so that the cleaning member cleans the reading surface as a result of moving the maintenance unit.

2. The inkjet recording apparatus according to claim 1, wherein the reading surface is long in a direction orthogonal to the conveying direction in an inner direction of the reading surface, and wherein the maintenance-unit moving mechanism moves the maintenance unit and the cleaning member in the direction orthogonal to the conveying direction.

3. The inkjet recording apparatus according to claim 2, wherein the image-sensor moving mechanism moves the image sensor from the image pickup position to the cleaning position by moving the image sensor in a direction perpendicular to the reading surface at the image pickup position and away from the conveying surface.

4. The inkjet recording apparatus according to claim 2, wherein the image-sensor moving mechanism moves the image sensor from the image pickup position to the cleaning position by rotating the image sensor around an axis extending in the direction orthogonal to the conveying direction so that the reading surface faces the inkjet head after moving the image sensor in a direction perpendicular to the reading surface at the image pickup position and away from the conveying surface.

5. The inkjet recording apparatus according to claim 1, wherein the reading surface and the cleaning member are long in a direction orthogonal to the conveying direction in an inner direction of the reading surface, and wherein the maintenance-unit moving mechanism moves the maintenance unit and the cleaning member in the conveying direction.

6. The inkjet recording apparatus according to claim 5, wherein, when the image-sensor moving mechanism moves the image sensor from the image pickup position to the cleaning position, after moving the image sensor in a direction perpendicular to the reading surface at the image pickup position and away from the conveying surface, the image-sensor moving mechanism rotates the image sensor around an axis extending in the direction orthogonal to the conveying direction so that the reading surface faces a side opposite to the conveying surface.

7. An inkjet recording apparatus comprising:

a conveying section having a conveying surface that is configured to convey a recording medium in a conveying direction;

an inkjet head having a discharge surface that has a discharge port and that opposes the conveying surface, the discharge port configured to discharge ink;

a maintenance unit configured to maintain the inkjet head;

a maintenance-unit moving mechanism configured to move the maintenance unit between a maintenance position, where the maintenance unit opposes the discharge surface, and a withdrawal position, where the maintenance unit does not oppose the discharge surface;

an image sensor capable of picking up an image on a surface of the recording medium conveyed by the conveying section or on the conveying surface, the image sensor having a reading surface that opposes the conveying surface;

a cleaning member secured to the maintenance unit and configured to clean the reading surface; and an image-sensor moving mechanism configured to move the image sensor between an image pickup position, in which the image sensor is capable of picking up the image on the surface of the recording medium or on the conveying surface, and a cleaning position, in which the cleaning member is capable of cleaning the reading surface, wherein the image-sensor moving mechanism is configured to rotate the image sensor.

8. The inkjet recording apparatus according to claim 7, wherein the maintenance unit further comprises a wiper configured to wipe the discharge surface of the inkjet head.

9. The inkjet recording apparatus according to claim 8, wherein the maintenance unit is configured to move only on one axis.

10. The inkjet recording apparatus according to claim 8, wherein the maintenance unit is configured to move in the conveying direction.

11. The inkjet recording apparatus according to claim 8, wherein the maintenance unit is configured to move perpendicular to the conveying direction.

12. The inkjet recording apparatus according to claim 7, the image-sensor moving mechanism being configured to rotate the image sensor a quarter turn away from the conveying surface.

13. The inkjet recording apparatus according to claim 7, the image-sensor moving mechanism being configured to rotate the image sensor a half turn away from the conveying surface.

14. The inkjet recording apparatus according to claim 7, wherein the cleaning member only includes a sponge.

* * * * *